United States Patent [19]

Piesik

[11] 4,327,624

[45] May 4, 1982

[54] TIP OFF RATE REDUCER

[75] Inventor: Edward T. Piesik, Pomona, Calif.

[73] Assignee: General Dynamics, Pomona Division, Pomona, Calif.

[21] Appl. No.: 162,290

[22] Filed: Jun. 23, 1980

[51] Int. Cl.[3] ..... F41F 3/04

[52] U.S. Cl. ..... 89/1.816; 89/1.703; 89/14 C

[58] Field of Search ..... 89/1.816, 1.819, 1.817, 89/1.810, 1.8, 1.7, 1.703, 1.704, 1.705, 14 C

[56] References Cited

U.S. PATENT DOCUMENTS

| | | | |
|---|---|---|---|
| 2,442,382 | 6/1948 | Sieg | 89/1.7 X |
| 2,447,205 | 8/1948 | Powell | 89/14 C X |
| 2,818,779 | 1/1958 | Koeper | 89/1.819 |
| 2,998,752 | 9/1961 | Couts | 89/1.819 |
| 3,021,760 | 2/1962 | Musser | 89/1.7 |
| 3,225,655 | 12/1965 | Inglis | 89/1.816 |
| 3,946,637 | 3/1976 | Campagnuolo et al. | 89/1.703 X |
| 4,106,389 | 8/1978 | Walley | 89/1.816 X |

FOREIGN PATENT DOCUMENTS

| | | | |
|---|---|---|---|
| 974679 | 10/1950 | France | 89/1.816 |
| 81856 | 7/1951 | Norway | 89/1.816 |

*Primary Examiner*—David H. Brown

*Attorney, Agent, or Firm*—Neil F. Martin; Edward B. Johnson

[57] ABSTRACT

Disclosed is a launcher-missile system with the launcher tube provided with a configuration on its aft end so as to reduce the tip-off rates of the system. The configuration comprises the formation of an open sector in the flared end of the launcher tube so that a portion of the exhaust gases exiting from the tube, as the missile is fired, does not impinge on that sector of the flared end and thus an impulse caused by the impinging of the gases on the remainder of the flared end reduces the tip-off rate.

Also disclosed is a means in which the size and location of the open sector can be selected depending upon the desired change in magnitude and direction of the tip-off rate.

7 Claims, 5 Drawing Figures

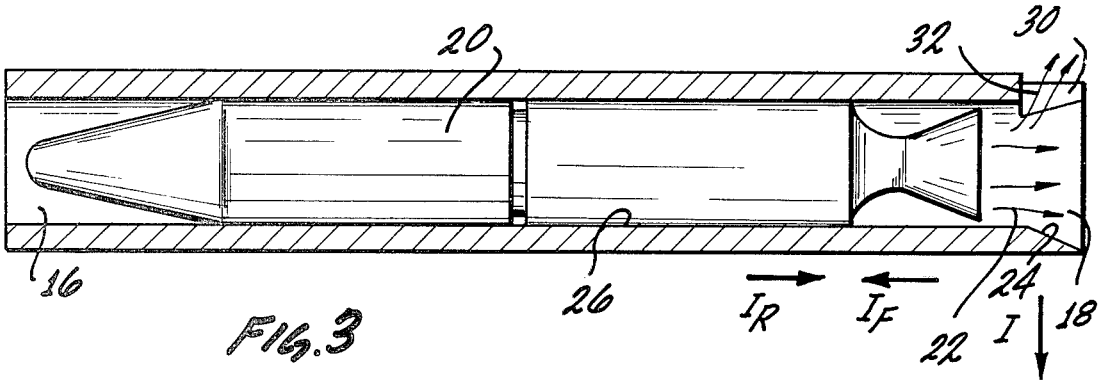
FIG. 3
FIG. 5
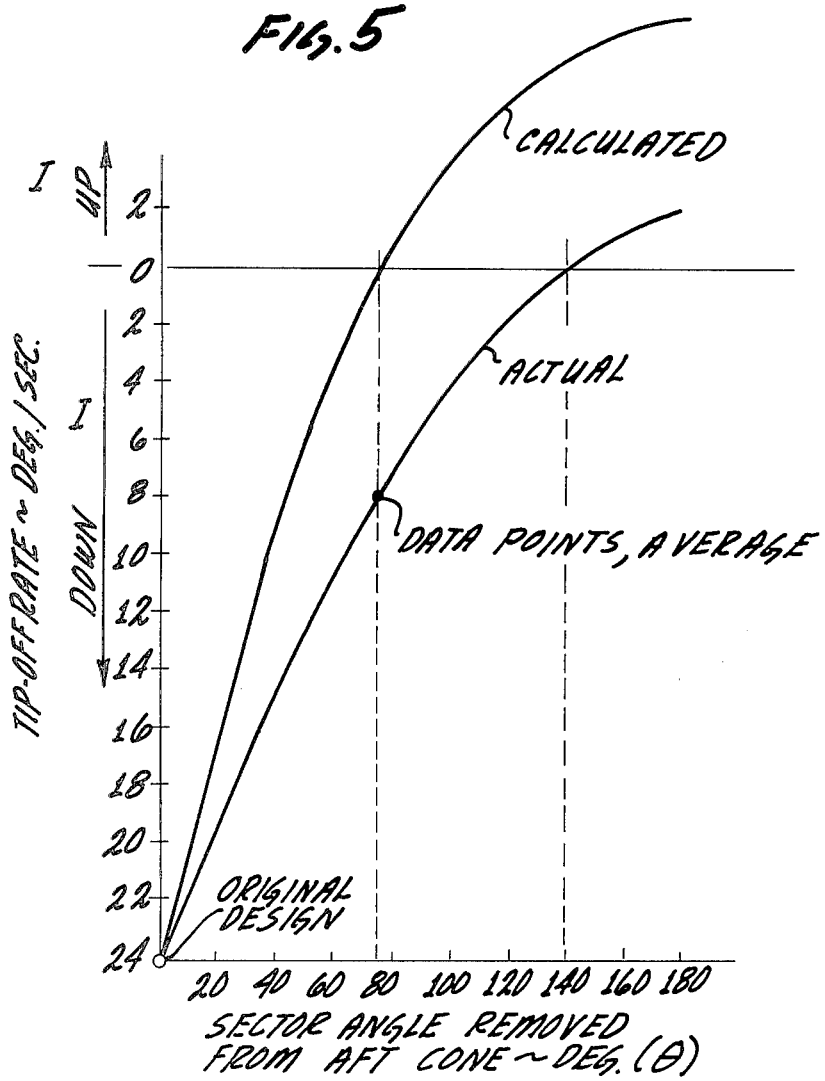

TIP OFF RATE REDUCER

The Government has rights to this invention pursuant to contract No. DAAHOl-72-C-0773 awarded by the U.S. Army.

BACKGROUND OF THE INVENTION

This invention relates to launcher missile systems and, more particularly, to launcher tubes having means for reducing, or changing, the direction of the tip-off rates of a launcher missile system.

It is well known that one of the contributing causes of dispersion of a missile is the deflection imparted to the missile during emergence from the launcher tube. This deflection is called "tip-off" and has been considered in the prior art to be primarily a function of the gravitational forces acting on the missile at a time when the missile center of gravity has passed the forward end of the launcher tube causing the missile to nose down and, the magnitude of the tip-off was expressed, and still is, in degrees per second as the "tip-off rate".

It has now been found that tip-off is more than a function of gravity acting on a partially emerged missile but is a function of the missile, the launcher tube, and the launcher tube/missile supporting mechanism (whether a person or a mechanical device); all acting together as a system. Tip-off is inherent in the system and it has also been discovered that tip-off does not always occur in a downward direction but can be any direction and at different rates depending on the type of system.

With the tip-off thus being in any direction and at different rates, it can be seen that is is desirable to reduce the tip-off rate in whatever direction it occurs in the launcher-missile system.

This invention provides a means for reducing the tip-off rate in a launcher-missile system and this is, therefore, one object to this invention.

It also might be desirable, in certain instances, to overcompensate tip-off rate to produce a tip-off rate in the opposite direction, as for example, if the tip-off rate were downward, to provide a tip-off rate upwardly, and thus accurately align the missile on its intended course.

This invention also teaches how to not only reduce the tip-off rate of a launcher missile system but how to provide a tip-off which is opposite to that occurring in the system, and this, therefore, is still another object of this invention.

SUMMARY OF THE INVENTION

The invention which attains the foregoing objects comprises a launcher-missile system in which an open sector is formed in the flared aft end of the launcher tube so that a portion of the exhaust gases exiting from the launcher tube does not impinge on the aft end but rather freely expands into the ambient air through the open sector and thus an impulse caused by the impinging gases on the remainder of the flared end reacts in a direction opposite to the open sector, thus reducing the tip-off rate.

The size and location of the open sector depends upon the desired change in tip-off rate in both magnitude and direction. The tip-off rate can be reduced to zero or even given a negative, or oppositely, acting impulse from the original tip-off direction, if desired, to correctly align the missile on its selected course.

BRIEF DESCRIPTION OF THE DRAWINGS

FIG. 3 is a longitudinal sectional view of the launch illustrating a missile in launch position.

FIG. 5 is a plot of tip-off rate verses sector angle.

DETAILED DESCRIPTION OF THE INVENTION

Figure 1:
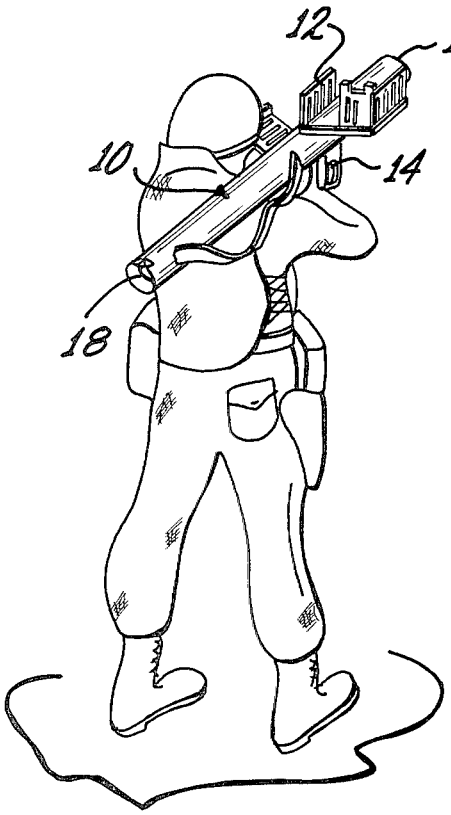
FIG. 1 is a perspective view of the shoulder-carrier missile launcher system incorporating the tip-off rate reducer.

Turning now to the drawings, there is illustrated a shoulder fired cylindrical launcher tube 10 illustrated in firing position and being aimed and fired through the use of suitable sighting means 12 and trigger means 14. The fired missile will emerge from the forward end 16 while exhaust gases will flow out the aft end 18.

Figure 2:
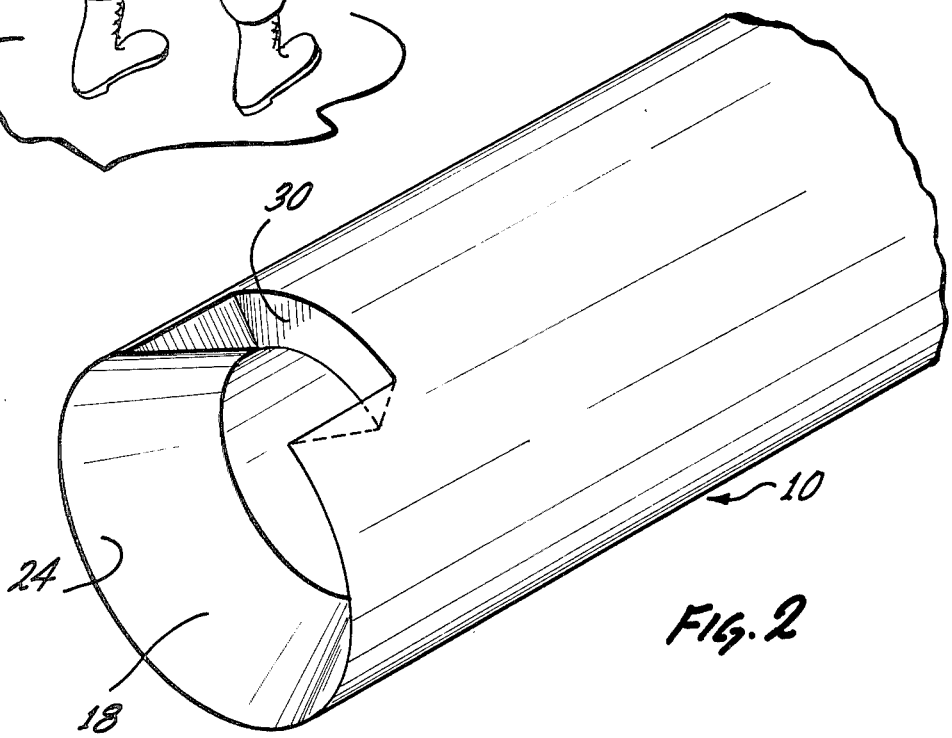
FIG. 2 is an enlarged perspective view of the aft portion of the launcher tube.

It is understood, before going further in the description that, while this invention is shown embodied in a shoulder fired launcher tube, the invention applies equally well to launcher tubes having mechanical supporting devices. Too, as shown more clearly in FIGS. 2 and 3, the aft end has been simplified for the purposes of disclosure by the removal of a portion of the aft cover assembly normally used in launcher tubes of this type.

Now continuing on, as shown in FIG. 3, when a missile such as 20, is fired from the forward end 16 of the launcher tube, as stated before, exhaust gases will exit out the aft end 18. This is represented by arrows 22. The aft end is provided with a flare in the form of a conical surface 24 to reduce the tube recoil by providing a surface against which some of the exhaust gases expand and impinge directing a forward impulse (pressure times area times time) $I_F$ which opposes the recoil impulse $I_R$ imposed on the launcher tube in the aft direction as they react against the inside wall 26 of the tube.

During firing of the missile 20 from the launcher tube 10, the missile can be deflected from its intended course. This deflection is called "tip-off" and is a function of the design of the missile, the launcher tube, its or their respective centers of gravity, and the launcher tube supporting mechanism, whether the latter is a person or a mechanical device. These factors all act together as a system and, it has been found that tip-off does not always occur in any one direction but can be in any direction and in different amounts depending on the type of system. The amount of such deflection per unit time is called tip-off rate and is measured in degrees per second.

This invention provides a means for reducing the tip-off rate in launcher-missile systems and, in the embodiment shown, to accomplish this results, the conical surface 24 of the aft end 18 of the launcher tube 10 is provided with a space, or open sector, 30 formed by removing material from the full 360° conical surface. With this open sector 30, or discontinuity, embodied in the conical surface 24, some of the exhaust gases, which are normally impinging on the full 360° surface to produce the aforesaid recoil reduction, are now vented to ambient air, that is, simply allowed to expand upwardly as illustrated by arrows 32. Such vented gases do not induce a forward component of force on that sector with the result that there is an imbalance which forces the aft end in the direction opposite from the open sector, which for the purposes of this disclosure, is represented by a downwardly directed impulse I. Of course, as mentioned before, the impulse I need not be directed down since its direction is a function of the location of the open sector in the 360° conical surface.

Figure 4:
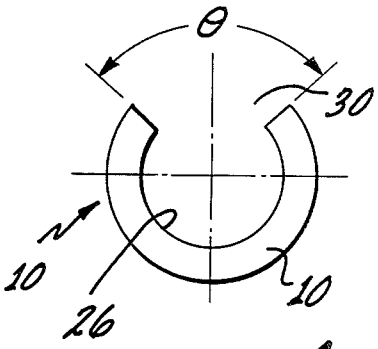
FIG. 4 is a diagramatic end view of the launcher tube illustrating the open sector.

Turning now to FIG. 5, which is a graph wherein tip-off rate (X direction) is plotted against sector angle (Y direction), it will be clear that the downward pulse I is a function of the angular amount of open sector that is removed from the 360° conical surface. This graph of FIG. 5 illustrates an actual original design launcher tube having a downwardly directed tip-off rate of 24 degrees per second and is identified by the wording "original design". This rate is considered excessive in any launcher-missile system, particularly a shoulder fired system, since there is a possibility of not only the inaccuracy in the launch of the missile, but harm to the user. Thus, accepting the concept of an open sector 30 in the conical surface, and taking into consideration many factors including the center of gravities involved in the system, calculations were made which indicated that the tip-off rate in the original design launcher tube could be reduced to zero with a 70° open sector. This is represented by $\theta$ in FIG. 4. The calculated reduced tip-off rate is represented by the cross over of the curve identified as "calculated" at the zero Y line on the graph of FIG. 5 and shown to be at a sector angle of 70°. This graph also shows that according to the "calculated" curve, the tip-off can be given an oppositely directed rate or an up tip-off rate, in the case of a downwardly directly tip-off rate, as represented by the continuing of the cross over of the curve above the zero tip-off rate point, up to and limited to 180° sector angle removed from aft cone.

In actual practice, however, it was determined that the inventive concept did indeed work but more sector angle would be required to be removed than calculated to reduce the tip-off rate to zero. This is represented by the curve identified as "actual" and was plotted from the results of a series of firings utilizing the same launcher tube and missile design. Thus, under actual testing less than a zero tip-off rate was reached with the removal of a portion of material to a sector angle of about 70°. Extrapolation of firing data also showed that in this particular system, a removal of about 140° would give a zero tip-off rate and that an up tip-off rate, again in the case of a down tip-off rate, could be also accomplished by removing even a greater amount of material but less than 180° to form a greater sector angle.

While the foregoing refers to the removal of a sector from the cone section already manufactured as part of the aft portions of the launcher tube, obviously, the open sector can be formed during the initial manufacture of the conical surface once having understood the teachings of this invention and having arrived at the desired tip-off rate reduction and direction thereof.

From the above description it can be seen that there is provided a means for reducing or changing the tip-off rate, both in magnitude and direction, and while the invention has been illustrated and described by means of a single embodiment it is to be understood that changes and modifications may be made therein without departing from the spirit and scope of the invention which is defined by the appended claims. For example, the 140° point in FIG. 5 is for a specific system, any other system would have a different design more similar to, but different from, FIG. 5.

What is claimed is:

1. In a missile-launcher system, a launcher tube with a forward end from which a missile exits upon firing and an aft end from which gases exhaust as a missile exits from the launcher tube, means on the aft end of said launcher tube against which said exhaust gases impinge for reducing the recoil imparted to the launcher tube as the missile is fired, the improvement comprising, means forming part of said recoil reducing means for reducing the tip-off rate of the launcher tube during firing.

2. The improvement as claimed in claim 1 wherein said recoil reducing means comprises a conical surface formed on the aft end of said launcher tube.

3. The system as claimed in claim 2 wherein said means for reducing said tip-off rate comprises a sector on said conical surface which allows the exhaust gases to flow freely into ambient air without impinging on the conical surface in the area of the sector.

4. The improvement as claimed in claim 3 wherein said sector constitutes a discontinuity in the conical surface such that exhaust gases do not impart a forward pressure force on the conical surface in the area of the sector.

5. The improvement as claimed in claim 4 wherein the sector comprises a discontinuity in the conical surface in the amount necessary to reduce the tip-off rate to zero.

6. The improvement as claimed in claim 5 wherein said sector comprises a discontinuity in the conical surface of about 140° of the conical surface so as to reduce the tip-off rate to zero.

7. The improvement as claimed in claim 5 wherein the sector comprises a discontinuity in the conical surface greater than about 140°, but limited to 180°, to provide a negative or oppositely acting tip-off rate.

* * * * *